United States Patent [19]

Yukimoto et al.

[11] Patent Number: 5,005,688

[45] Date of Patent: Apr. 9, 1991

[54] DEVICE FOR VALIDATING AND ACCUMULATING BILLS AND COINS

[75] Inventors: Koji Yukimoto; Hiroshi Hayashi, both of Sakado, Japan

[73] Assignee: Nippon Conlux Co., Ltd., Tokyo, Japan

[21] Appl. No.: 369,313

[22] Filed: Jun. 21, 1989

[30] Foreign Application Priority Data

Jun. 23, 1988 [JP] Japan ..... 63-83359[U]
Jun. 28, 1988 [JP] Japan ..... 63-100275[U]

[51] Int. Cl.[5] ..... G07F 7/04
[52] U.S. Cl. ..... 194/206; 453/56
[58] Field of Search ..... 194/206, 207; 453/7, 453/11, 56

[56] References Cited

U.S. PATENT DOCUMENTS 4,503,963 3/1985 Steiner ..... 194/206 X
4,733,765 9/1988 Watanabe ..... 194/206
4,850,468 7/1989 Kabayashi et al. ..... 194/207
4,880,096 11/1989 Kobayashi et al. ..... 194/206

*Primary Examiner*—H. Grant Skaggs
*Attorney, Agent, or Firm*—Koda and Androlia

[57] ABSTRACT

In a device for validating and accumulating bills and coins for fixed and movable chute mechanisms forming therebetween a bill passage and magnetic heads provided above the bill passage for validating bills passing thereby, and head pressing rollers for pressing bills against the magnetic heads from the opposite side of the bill passage. A feature of this device is that, when a counterfeit bill is to be returned by reversing the travel of a bill conveying belt constituting one part of a fixed chute mechanism, a mechanism automatically operates to move each head pressing roller clear of the bill passage thereby to prevent jamming of the bill. Another feature is that the driving shafts respectively of the bill conveying belt and of a coin conveying belt are coaxially coupled by way of a one-way clutch, whereby when the bill conveying belt is driven in reverse dirction for rejection and return of a bill, the coin conveying belt is stopped thereby to prevent reverse conveying coins.

2 Claims, 4 Drawing Sheets

DEVICE FOR VALIDATING AND ACCUMULATING BILLS AND COINS

BACKGROUND OF THE INVENTION

This invention relates generally to cash (bills and coins) discriminating and accepting devices and more particularly to a device for validating and accumulating cash inserted thereinto in which a bill conveying belt and a coin conveying belt are provided separately, and the genuine/counterfeit character of each bill and coin thus inserted is discriminated, genuine cash being accumulated within the device.

Various automatic cash-operated machines such as automatic vending machines, change dispensing machines, game machines, and record-playing machines (hereinafter referred to as vending machines and the like) each of which, in the same machine, accepts both paper money or bills and coins are widely used. In a vending machine of this character, in the part thereof for introducing bills and coins into the machine interior, a bill conveying belt and a coin conveying belt are parallelly provided. These belts are generally driven by an electric motor by way of a common driving shaft. In a machine of this character, each bill is clamped against the bill conveying belt by guide rollers or pressing rollers at intermediate positions and is sent inward through a bill passage. During this operation, necessary discriminating inspection is carried for each bill by a magnetic head, and genuine bills are ultimately sent into a collecting box within the housing of the cash discriminating and accepting device within the machine to be accumulated in stacked state.

In the known bill discriminating and receiving device described above, counterfeit bills are occasionally used. In such a case, the counterfeit nature of the bill is detected, and thereafter the bill conveying belt is driven in reverse direction thereby to return the bill to the insertion opening. At this time there has been a problem in that the head pressing roller becomes an obstruction and, at its place, causes the bill being returned to become jammed. Another problem is that when the bill conveying belt is reversed during the returning of a counterfeit bill, the coin conveying belt also moves in unison in the reverse direction, whereby coins are returned.

SUMMARY OF THE INVENTION

Accordingly, it is an object of this invention to provide a cash validating and accumulating device in which, by preventing a bill being returned through a bill passage from becoming jammed at the place of the head pressing roller, the bill is returned smoothly to the insertion opening.

Another object of the invention is to provide a cash validating and accumulating device in which, when it becomes necessary to return a bill which has once been inserted through the insertion opening, only the bill conveying belt is driven in reverse with the coin conveying belt in stopped state, and the bill is thus returned to the bill insertion opening.

One of the aforedescribed problems has been solved by this invention, according to which, in a bill validating and accumulating device in which a magnetic head for discriminating bills is provided above the bill passage, and a head pressing roller is provided to press each bill against this magnetic head from the opposite side of the bill passage, the head pressing roller is rotatably supported on one end of a roller support lever which is pivotally supported at a middle part thereof, and the other end of the roller support lever is coupled to the working end of the plunger of an actuating solenoid.

By this feature of this invention, when it is necessary to return an inserted bill back to the insertion opening, the actuating solenoid is energized to rotate the roller support lever and thereby to separate the head pressing roller from the bill passage. Thus a clearance gap without obstruction is assured through the bill passage, whereby the bill can be returned smoothly to the insertion opening without clogging or jamming thereof in the bill passage.

Another of the aforedescribed problems has been solved according to this invention by the provision of a bill validating and accumulating device which has a bill conveying belt and a coil conveying belt both driven in unison by a common driving shaft, and in which the driving pulleys of the bill conveying belts are fixedly supported on the driving shaft and therefore rotate in unison therewith in two rotational directions, whereas the driving pulley of the coin conveying belt is supported on the driving shaft by way of a one-way clutch, whereby, when a bill is invalidated and is being returned by reverse direction rotation of the driving shaft, the driving pulley of the coin conveying belt is stopped, and only the driving pulleys of the bill conveying belts are driven in said reverse direction.

By this feature of the invention, when the common driving shaft is rotated to convey bills and coins into the device, the bill conveying belt moves in the conveying inward direction. At the same the rotation is transmitted in synchronism and in the same direction also to the driving pulleys of the coin conveying belt by way of the one-way clutch. Thus the coin conveying belt is also rotated in the same direction. However, when it becomes necessary to return a bill, the bill conveying belt is moved in reverse direction, but on the coin conveying side, since driving rotation is cut off at the one-way clutch, the second driving shaft is maintained in its stopped state. Thus unnecessary returning of the coins is prevented.

The nature, utility, and further features of this invention will be more clearly apparent from the following detailed description when read in conjunction with the accompanying drawings, briefly described below.

Directions such as left, right, front, and rear referred to herein are those as viewed by a purchaser facing the device for inserting a bill or coin thereinto.

DETAILED DESCRIPTION OF THE INVENTION

Figure 1:
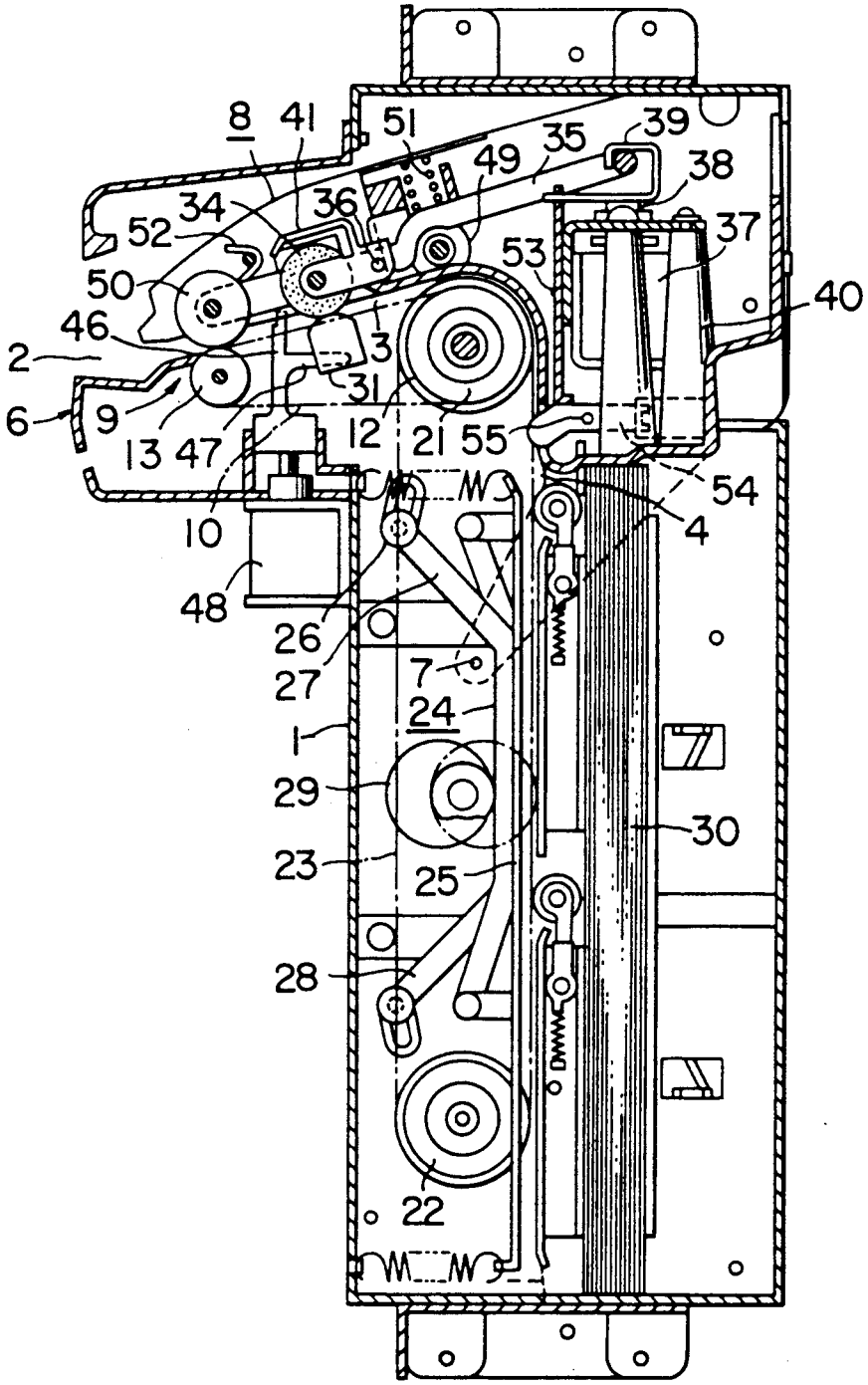
FIG. 1 is a side elevation, in vertical section, of one example of the cash validating and accumulating device according to this invention.

One example of a money validating and accumulating device constituting an embodiment of this invention is illustrated in FIG. 1. This device is enclosed within a housing 1 provided on its front face with a money insertion slot 2. Within this housing 1 are provided a substantially horizontal bill passage 3 extending continuously in a path resembling the character L so as to communicate with the insertion slot 2 and a substantially vertical bill passage 4 continuously joined to the bill passage 3 and extending downward.

Figure 2:
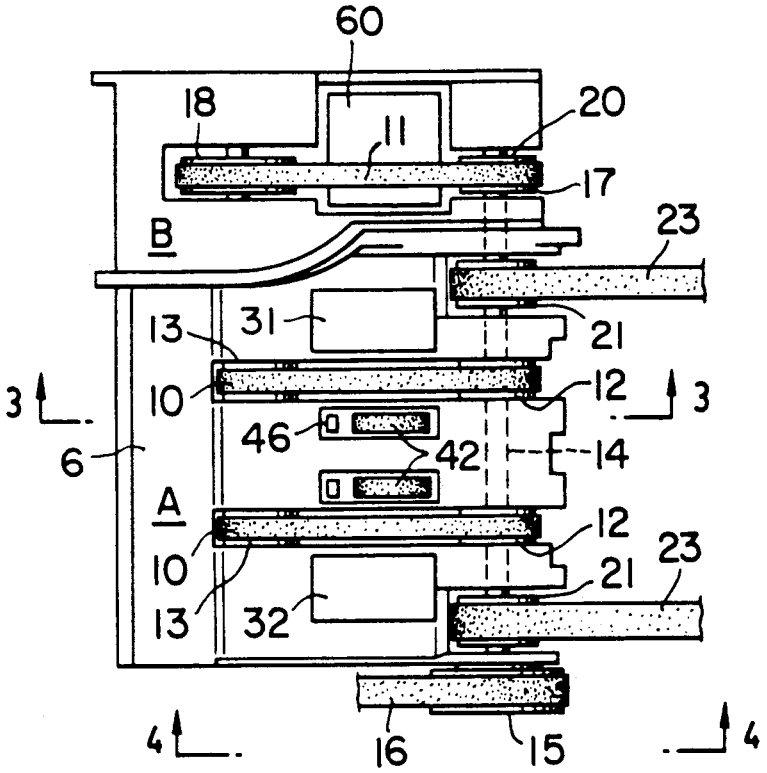
FIG. 2 is a plan view showing the bill and coin conveying parts of a lower fixed chute mechanism.

The bill passage 3 is formed between a fixed chute 6 provided unitarily with the housing 1 at the upper part thereof and a complementary movable chute 8 which is disposed above the fixed chute 6 and is rotatable about a horizontal pivot shaft 7. As is shown in FIG. 2, to the rear of the fixed chute 6 is provided a money conveying device which comprises a bill taking-in section A and a coin taking-in section B. In the bill taking-in section A, a pair of bill conveying belts 10, 10 are mounted parallelly with a space therebetween and have substantially horizontal conveying paths, while, in the coin taking-in section B, a single coin conveying belt 11 also having a substantially horizontal conveying path is mounted. It is desirable that these conveying belts 10, 10 and 11 be so supported that their conveying surfaces are projecting slightly above the upper surface of the fixed chute 6.

Figure 4:
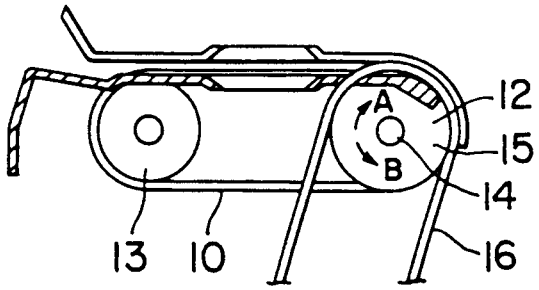
FIG. 4 is a section taken along the plane indicated by line 4—4 in FIG. 2.

Each of the two bill conveying belts 10, 10 is passed or received around a driving pulley 12 and a driven pulley 13. The two driving pulleys 12 are fixedly mounted on a common driving shaft 14 which extends horizontally in the left-right direction and is rotatable in two directions. As shown in FIGS. 2 and 4, a driving pulley 15 is fixedly mounted on one end of this driving shaft 14 and can be driven in rotation in either a regular direction or the reverse direction by an electric motor (not shown) by way of a driving belt 16.

Figure 5:
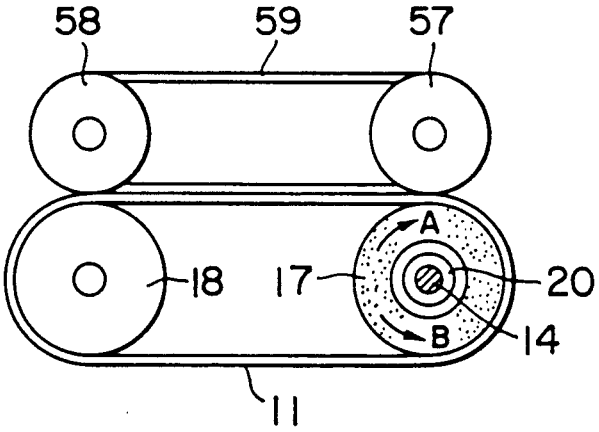
FIG. 5 is a side elevation showing a coin conveying belt and related parts.

The coin conveying belt 11 of the coin taking-in section B, as shown in FIG. 5, is passed around a driving pulley 17 and a driven pulley 18. The driving pulley 17 is mounted on the driving shaft 14, by way of a unidirectional or one-way clutch 20 (also known as a free-wheeling clutch) Therefore, the driving pulley 17 of the coin conveying belt 11 rotates in only the takingin direction A in FIG. 5 but does not move in the carryout direction B and maintains its stopped state when the driving shaft 14 is rotated in reverse. For the one-way clutch 20, any of various known mechanisms can be used.

A pair of driving pulleys 21, 21 are also fixedly supported on the above described driving shaft 14 at spaced-apart positions respectively on the left and right sides of the driving pulleys 12, 12. A matching pair of driven pulleys 22, 22 are rotatably supported near the bottom of the housing 1 as shown in FIG. 1 and are coupled to respective driving pulleys 21, 21 by respective receiving belts 23, 23 passed therearound. The conveying surfaces of these receiving belts 23, 23 lie in substantially vertical planes.

On the inner side of these receiving belts 23, 23 is provided a bill pushing-in device 24, which comprises a pushing plate 25, a pair of links 27 and 28, and a motor driven eccentric cam 29. The pushing plate 25 operates to push each bill which has arrived, upon being sent by the receiving belts 23, 23, in the rearward direction perpendicular to the surface of the bill. Each of the links 27 and 28 is pivotally connected at its one end to the front face of the pushing plate 25 and at its other end to a fixed pin 26 by way of a slot. To the rear of the bill passage 4 is provided a bill collecting box 30 for collecting bills which have been pushed rearward by the pushing-in device 24.

Figure 6:
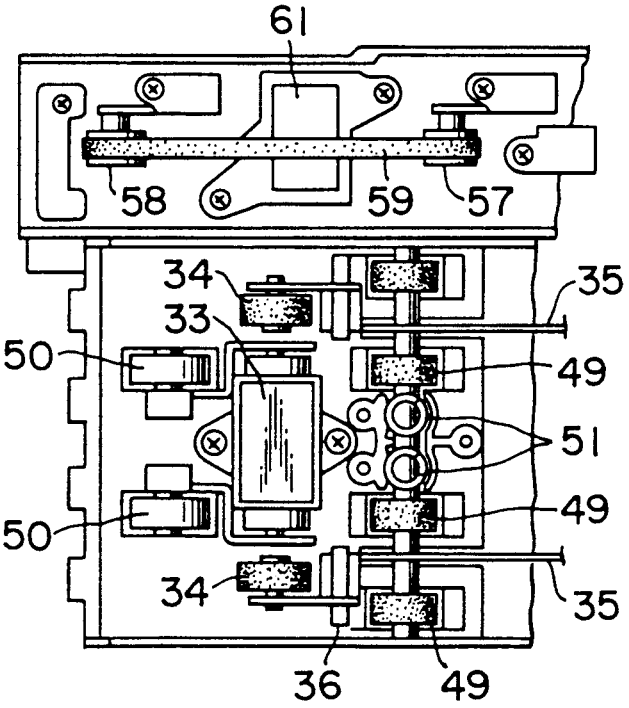
FIG. 6 is a plan view showing bill validating parts of an upper movable chute mechanism.

On the left and right sides of the two conveying belts 10, 10 to the rear of the fixed chute 6 are disposed first and second magnetic heads 31 and 32 for discriminating the genuine/counterfeit character of each bill as shown in FIG. 2. On the movable chute 8 side, at a position corresponding to that between the first and second magnetic heads 31 and 32, a third magnetic head 33 is disposed as shown in FIG. 6. These magnetic heads are provided with respective head pressing rollers for pressing each bill against the magnetic heads as will be described hereinafter.

On the side of the movable chute 8 and on the left and right sides of the third magnetic head 33, as shown in FIGS. 6 through 9, are disposed head pressing rollers 34, 34 for the first and second magnetic heads 31 and 32. As will be apparent from FIG. 8, each of these head pressing rollers 34, 34 is rotatably supported at an extreme end of a first roller support arm 35. Each first roller support arm 35 at an intermediate part thereof is rockably supported relative to the movable chute 8 by a horizontal pivot shaft 36. The other end of each roller support arm 35 is coupled to the output end 39 of the movable plunger 38 of a first driving solenoid 37. This first driving solenoid 37 is supported by a support post 40 within the movable chute 8. It is preferable to provide a magnetic shielding plate 41 above the head pressing rollers 34, 34 in order to lessen the effect of residual magnetism toward the outside.

Figure 3:
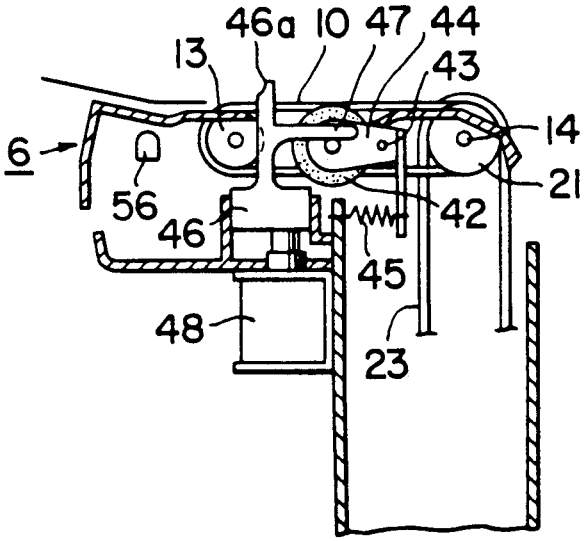
FIG. 3 is a side elevation, in vertical section taken along the plane indicated by line 3—3 in FIG. 2.

As shown in FIG. 2, between the conveying belts 10, 10 head pressing rollers 42, 42 for pressing against the third magnetic head 33 are disposed. Each of these head pressing rollers 42, 42 is rotatably supported on one end of a second roller support arm 44 of bell-crank shape rockably supported by a horizontal pivot pin 43. The other end of each roller support arm 44 is biased by a spring 45 to urge the arm 44 to rotate clockwise as viewed in FIG. 3. As means for separating each head pressing roller 42 from the bill passage 3, a lateral arm 47 unitarily formed with a shutter 46 is used. This shutter 46 is so actuated by a second driving solenoid 48 as to project its end 46*a* into the bill passage 3.

Figure 7:
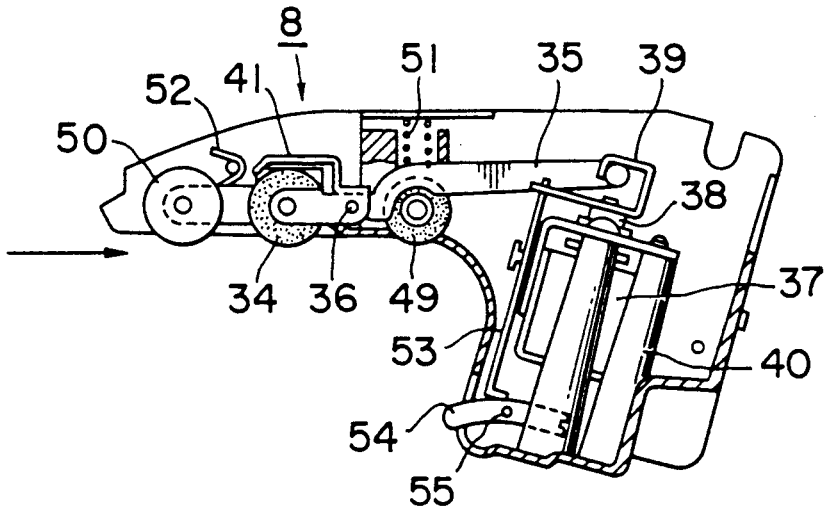
FIG. 7 is a side elevation, in vertical section, orthogonal to FIG. 6.
Figure 8:
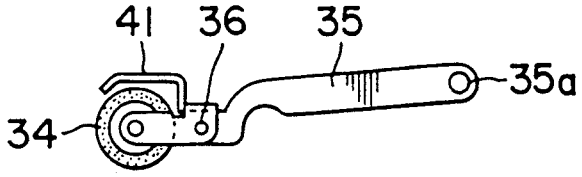
FIG. 8 is a partial side elevation showing one of two magnetic head pressing rollers and its supporting and actuating mechanism in the upper chute-mechanism shown in FIGS. 7 and 8.

The movable chute 8 is further provided, as shown in FIGS. 5, 6 and 7, with outer guide rollers 50, 50 near the entrance of the chute and inner guide rollers 49, 49 near the bend in the chute. These guide rollers 50, 50 and 49, 49 are so positioned as to contact from above the aforedescribed bill conveying belts 10, 10 on the driven pulleys 13 and the driving pulleys 12, respectively. Furthermore, the horizontal roller shaft of the inner guide rollers 49, 49 is pressed downward by coil springs 51, while the outer guide rollers 50 are urged downward by springs 52, 52.

Figure 9:
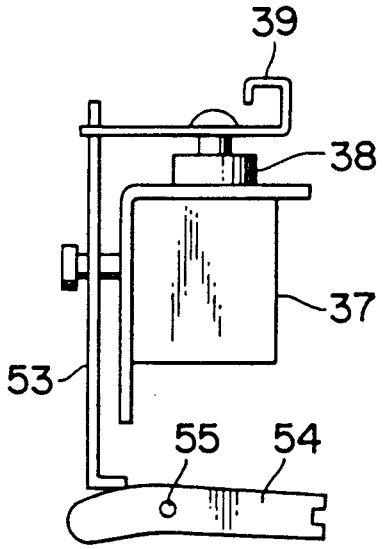
FIG. 9 is a partial side elevation showing a lever for opening and closing a bill passage and a mechanism for actuating this lever.

As shown in FIGS. 1 and 9, an actuating member 53 constituting a lever releasing mechanism is secured vertically to the output or working end of the plunger 38 of the first driving solenoid 37. The lower end of this actuating member 53 engageable with a lever 54 for opening and closing the vertical bill passage 4. This lever 54 is pivotable about a horizontal pivot pin 55 and is operated to close the bill passage 4 after a bill has finished passing thereby. When a bill, upon being discriminated as being counterfeit, is to be returned, the actuating member 53 is actuated so as to press the lever 54 downward. As a result, the lever 54 can be released synchronously with the roller pressing arm 35. The reference numeral 56 in FIG. 3 designates an inlet sensor. Furthermore, as shown in FIG. 5, an inner guide roller 57 is provided above the driving pulley 17 while an outer guide roller 58 is provided above the driven roller 18, both above the coin conveying belt 11. The inner guide roller 57 is coupled to the outer guide roller 58 by means of a belt 59.

The cash validating and accumulating device according to this invention of the above described organization operates in the following manner.

When a purchaser insert a cash for the purpose of buying a commodity, a driving motor (not shown) starts and transmits driving power via the driving belt 16 to drive the driving shaft 14 in rotation in the arrow direction A as shown in FIG. 4. The bill conveying belts 10, 10 are thereby driven in their conveying direction. Simultaneously, driving power is transmitted by way of the one-way clutch 20 also to the driving pulley 17 to rotate the same in the same direction. The coin conveying belt 11 is also driven in synchronism in its conveying direction.

At this time, the first head pressing rollers 34, 34 are pressed into contact with surfaces of the magnetic heads 31 and 32, while the second head pressing rollers 42, 42 are pressed into contact with the third magnetic head 33. Thus, these mechanisms are in their condition for discriminating the genuine/counterfeit character of each bill. Furthermore, the inserted coins are identified by an electronic sorting means 60, 61.

Therefore, each bill inserted through the insertion slot 2 is sent inward through the bill passage 3, being clamped between the bill conveying belts 10, 10 and the guide rollers 50, 49. Then, as this bill passes by the magnetic heads 31, 32, and 33 at an intermediate part of its path, validation inspection of the genuine/counterfeit character of this bill is carried out. Thereafter a genuine bill passes by the lever 54 and, descending through the bill passage 4 and being urged by the receiving belts 23, 23, is sent toward the lower part of the housing 1. This bill is then collected in a stacked state in the collecting box 30 by the bill pushing device 24.

On the other hand, in the event that a bill inserted by a purchaser is damaged in some way, the purchaser decides to stop the purchase, or the bill is discriminated as being a counterfeit bill, it is necessary to return this inserted bill. This returning of the bill is detected by the magnetic heads 31, 32, and 33, which thereby generate corresponding signals. These signals cause the plungers of the first and second solenoids 37 and 48 to be energized respectively in their retracting direction thereby to separate the head pressing rollers 34 and 42 and the shutter 46 from the magnetic heads and the bill passage 3. As a result, the bill passages are opened, and the bill to be returned can be directred smoothly to the insertion opening. When it becomes necessary to return a bill which has been detected to be a counterfeit, the driving motor is operated in reverse rotation, whereupon only the driving shaft 14 is rotated in the arrow direction B in FIG. 4, while the driving pulley 17 is held in its stopped state Thus, only the bill conveying belts 10, 10 are rotated in reverse toward the insertion opening side, and the counterfeit bill is rejectingly returned.

We claim:

1. A device for validating and accumulating bills having a fixed chute mechanism and a movable chute mechanism forming therebetween a bill passage, magnetic heads provided above said bill passage for validating bills passing thereby, and head pressing rollers for pressing bills against the magnetic heads from the opposite side of the bill passage, said device being characterized in that each of said head pressing rollers is rotatably supported on one end of a roller support lever pivotally supported at a middle part thereof, and the other end of said roller support lever is coupled to a working end of a plunger of an actuating solenoid, an actuating member is secured vertically to the working end of said plunger, the lower end of the actuating member engageable with a lever which is pivotable about a horizontal pivot pin and is operated to open and close the vertical bill passage, when a bill is not validated and is returned in a reverse direction for rejection, said roller support lever and the lever are released synchronously to thereby prevent jamming of said bill due to obstruction by the head pressing roller.

2. A device for validating and accumulating bills and coins having a pair of parallel bill conveying belts each passed around a driving pulley and a driven, pulley and a coin conveying belt passed around a driving pulley and a driven pulley, said three driving pulleys being drivable by electric driving power through a common driving shaft, said device being characterized in that said driving pulleys of said bill conveying belts are fixedly supported on said driving shaft and therefore rotate in unison therewith in two rotational directions, whereas said driving pulley of said coin conveying belt is supported on said driving shaft by way of a one-way clutch, whereby, when a bill is invalidated and is being returned by reverse direction rotation of said driving shaft, the driving pulley of the coin conveying belt is stopped, and only the driving pulleys of the bill conveying belts are driven in said reverse direction.

* * * * *